US006159087A

United States Patent [19]

Birang et al.

[11] Patent Number: 6,159,087

[45] Date of Patent: Dec. 12, 2000

[54] END EFFECTOR FOR PAD CONDITIONING

[75] Inventors: Manoocher Birang, Los Gatos; John Prince, Los Altos, both of Calif.

[73] Assignee: Applied Materials, Inc., Santa Clara, Calif.

[21] Appl. No.: 09/241,910

[22] Filed: Feb. 2, 1999

Related U.S. Application Data

[60] Provisional application No. 60/074,292, Feb. 11, 1998.

[51] Int. Cl.[7] ..... B24B 1/00

[52] U.S. Cl. ..... 451/526

[58] Field of Search ..... 451/287, 526, 451/529, 534, 539; 51/307

[56] References Cited

U.S. PATENT DOCUMENTS

| | | | |
|---|---|---|---|
| 4,992,082 | 2/1991 | Drawl et al. | 51/295 |
| 5,011,513 | 4/1991 | Zador et al. | 451/287 X |
| 5,216,843 | 6/1993 | Breivogel et al. . | |
| 5,273,558 | 12/1993 | Nelson et al. . | |
| 5,380,390 | 1/1995 | Tselesin . | |
| 5,547,417 | 8/1996 | Breivogel et al. . | |
| 5,595,527 | 1/1997 | Appel et al. | 451/287 X |
| 5,620,489 | 4/1997 | Tselesin . | |
| 5,626,509 | 5/1997 | Hayashi . | |
| 5,643,067 | 7/1997 | Katsuoka et al. | 451/287 X |
| 5,683,289 | 11/1997 | Hempel, Jr. . | |
| 5,690,705 | 11/1997 | Holmes et al. | 51/307 X |
| 5,769,697 | 6/1998 | Nishio | 451/287 X |
| 5,779,521 | 7/1998 | Muroyama et al. | 451/287 X |
| 5,782,675 | 7/1998 | Southwick | 451/444 X |
| 5,851,138 | 12/1998 | Hempel, Jr. . | |
| 5,895,270 | 4/1999 | Hempel, Jr. . | |

FOREIGN PATENT DOCUMENTS

| | | |
|---|---|---|
| WO 94/04599 | 3/1994 | WIPO . |
| WO 97/40525 | 10/1997 | WIPO . |
| WO 99/02309 | 1/1999 | WIPO . |

OTHER PUBLICATIONS

International Search Report for PCT/US 99/02741.

*Primary Examiner*—David A. Scherbel
*Assistant Examiner*—Anthony Ojini
*Attorney, Agent, or Firm*—Dugan & Dugan

[57] ABSTRACT

An end effector is provided for conditioning pads used to polish semiconductor wafers. The end effector has a substrate with a matrix (preferably a polymer) disposed thereon. Abrasive particles such as diamond crystals are embedded in the matrix. Preferred particle size and number/spacing is provided for optimal conditioning. The particles are embedded by at least a predetermined amount (e.g., 75%) so as to provide uniform/repeatable conditioning while avoiding dislodged particles. The particles may be embedded such that the tips thereof are coplanar, or such that the profile of diamond tips form a plurality of curved regions. A method for checking end effector quality is also provided.

49 Claims, 5 Drawing Sheets

END EFFECTOR FOR PAD CONDITIONING

This application claims priority from U.S. provisional application Ser. No. 60/074,292, filed Feb. 11, 1998.

FIELD OF THE INVENTION

The present invention relates to the field of polishing pad conditioners, and most particularly to an improved end effector for conditioning pads used to polish the surface of semiconductor wafers or semiconductor devices.

BACKGROUND

In the semiconductor industry, semiconductor wafers are planarized using a chemical mechanical polishing apparatus that presses the wafer surface against an abrasive pad. As polishing continues, the surface of the pad may become compacted and lose its abrasive quality. Such compaction reduces the quality and efficiency of the polishing process. Accordingly, the abrasive pad is conditioned or roughened (in situ or ex situ) via a device known as a pad conditioning end effector. Typically the end effector comprises one or more diamond crystals held by mechanical means (e.g., by screw type holding mechanisms) and pressed against the surface of the polishing pad. When crystals are held via mechanical means, the crystals are necessarily relatively large and provide less than optimal pad conditioning. Accordingly, an improved pad conditioning end effector is needed.

SUMMARY OF THE INVENTION

The present invention overcomes the short comings of prior art end effectors by providing an end effector having a conditioning surface configured for both optimal pad conditioning, and for repeatable manufacture. Specifically, in a first aspect the end effector has a plurality of diamond crystals, wherein a predetermined percentage of each diamond crystal is embedded within the surface of the end effector. The embedded percentage is predetermined to prevent the crystals from dislodging during conditioning. The embedded amount may vary based on the surface material in which the crystal is embedded, and on the conditioning environment, e.g., rotational speeds, forces, exposure to corrosives, etc., in which the end effector will be used. Embedding 75% of each crystal works well for most applications although, for a given application, a greater or smaller percentage may prevent crystal dislodging.

In a second aspect, a known or predetermined quantity of crystals are embedded across the surface of the end effector. In a third aspect the crystals (which may be the same size, or may be of variable sizes) are embedded such that the non-embedded ends, i.e., the tips thereof, extend to a common plane. In a fourth aspect, the surface of the end effector consists of a plurality of raised regions (e.g., consists of a plurality of mesas and valleys), and the diamond tips extend radially from the edges of the raised regions.

The end effector preferably comprises a plurality of 200 $\mu$m diamond crystals spaced approximately 400 $\mu$m (measured from the center of adjacent crystals) and embedded 150 $\mu$m within a matrix disposed on a metal substrate. A more preferred end effector comprises a plurality of diamond crystals of varying size between 80–100 $\mu$m, spaced 200 $\mu$m apart. Most preferably these 80–100 $\mu$m diamond crystals are disposed across a plurality of raised regions and extend radially from the edges thereof, giving the end effector a surface profile comprising a plurality of radially curved edges. The predetermined quantity of the crystals allows for easy detection of missing crystals via surface scanning techniques or via capacitive measurement techniques, further described below. Moreover, the predetermined number, embedding, crystal size and the tips which extend to form a flat end effector surface profile or an end effector surface profile having a plurality of radially curved edges, provide a repeatable rate of pad conditioning, not only as the end effector wears, but also as between end effectors configured in accordance with the principles of the invention. Thus with use of the inventive end effector each type of surface, e.g., metal, oxide, etc., polished by the conditioned pads will be polished at the same rate and will be free of micro-scratches, improving the quality of the polished film.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Figure 1:
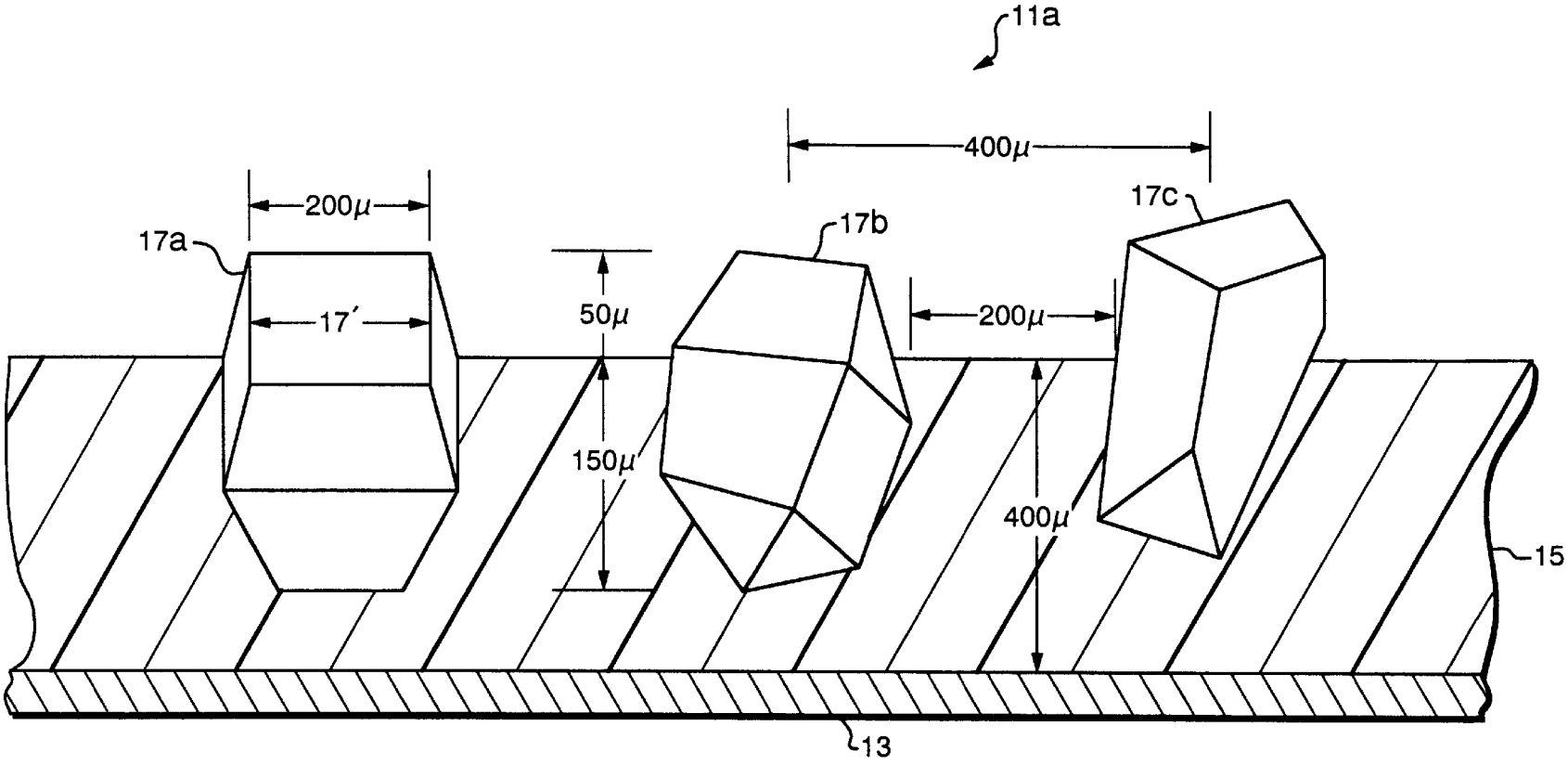
FIG. 1 is an enlarged side cross-sectional view of a first embodiment of an inventive end effector.

FIG. 1 is an enlarged side cross-sectional view of a first embodiment of an inventive end effector 11*a* which comprises a substrate 13 having a matrix 15 disposed thereon. Any conventional substrate material (e.g., stainless steel) may be employed as the substrate 13. The matrix material is preferably a polymer. When used in connection with the polishing of oxide layers the polymer is chemically inert so that it is not reactive with the polishing slurry. Further, should polymer particles become embedded on the surface of a silicon wafer being polished, the polymer particles (unlike particles of a metal matrix) will not act as a conductor. For an oxide polish the polymer's modulus is preferably substantially less than the modulus of oxide, fused silicon, or quartz. Although less preferred, nickel or nickel alloys have been successfully employed as the matrix 15. The matrix 15 is preferably treated to resist corrosion.

Embedded within the matrix 15 are three diamond crystals 17*a–c*. It will be understood that the three crystals are merely exemplary and in practice numerous crystals are preferably employed. The end effector 11 is configured in a manner preferred for use in connection with the polishing of metal layers. Specifically, it is believed that for a 20 inch diameter polishing pad, the optimal total length of the grooves formed in the polishing pad per pad revolution is 10 kilometers and that, for example, a plurality of 200 μm diamond crystals, having a cross section 17' which is 200 μm in length along the plane shared by the top surface of the matrix 15, pressed with a seven pound force against the surface of the polishing pad (shown in FIG. 3) provides the optimal balance between maintaining a consistent polishing rate, i.e., polishing rate maintenance, and polishing pad life. Accordingly, the diamond crystals 17*a–c* are shown in FIG. 1 as being 200 μm in length and having a 200 μm cross section 17'.

Although synthetic diamond crystals may be easily grown to a desired size, in practice the crystals 17*a–c* may vary between 100–300 μm along any of the faces thereof. However, assuming the diamond crystals 17*a–c* are 200 μm in length, 150 μm of each diamond crystal is embedded in the matrix 15 leaving 50 μm diamond crystal tips exposed.

The diamond crystals 17*a–c* are shown spaced approximately 400 μm between the centers of adjacent crystals, which, in this example equates to approximately 200 μm spacing between the nearest surfaces of adjacent crystals. The matrix has a depth of 400 μm in order to enable the diamond crystals 17*a–c* to be embedded 150 μm within the matrix 15 and to withstand the forces applied during pad conditioning without causing the matrix 15 to crack or otherwise yield.

The inventive end effector may be made in accordance with the methods disclosed in U.S. Pat. No. 5,380,390 titled "Patterned Abrasive Material and Method," the entire disclosure of which is incorporated herein by this reference. As described in further detail in U.S. Pat. No. 5,380,390, a substrate is coated with an adhesive and then is contacted with the abrasive particles (e.g., diamond crystals). The crystals which do not adhere are removed, and the adhered crystals are oriented, for example, by shaking/vibrating the substrate such that the adhered crystals assume a stable position, and/or by applying a magnetic force such that the crystals are aligned according to their crystallographic structure and according to the lines of magnetic force. Once oriented, the crystals may be sprayed with an adhesive, or sprayed with a liquid which is subsequently frozen, so as to maintain the crystals' orientation. Thereafter, to permanently hold the crystals they are contacted with a sinterable or fusible material (possibly in the form of a preform) and heat and/or pressure is applied to complete the abrasive material.

The inventive end effector 11*a* can be checked (before and after use) to ensure that a predetermined number of diamond crystals are present. Such quality checks can be performed via a conventional surface scan, or via a capacitive measurement technique (described further below).

Figure 2A:
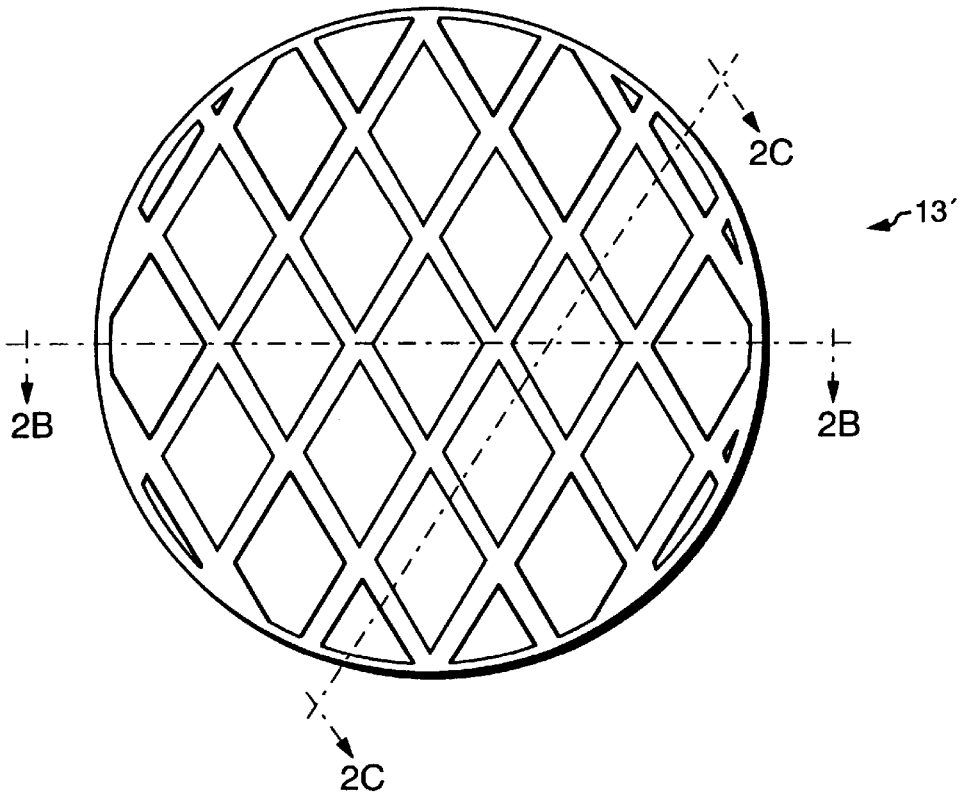
FIG. 2A is a top plan view of a preferred surface configuration employed as the inventive end effector's substrate.
Figure 2B:
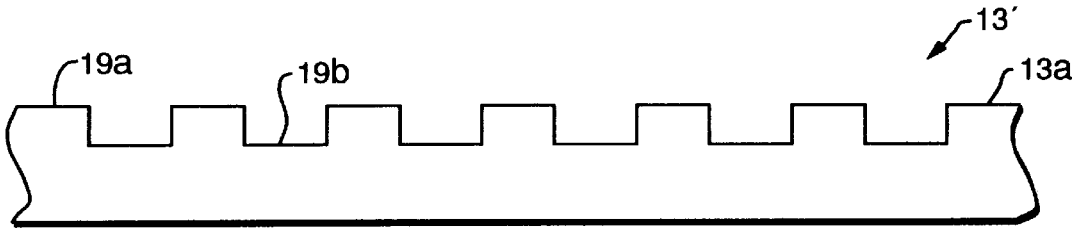
FIG. 2B is a side cross-sectional view of the substrate of FIG. 2A taken along the line 2B—2B in FIG. 2A.
Figure 2C:
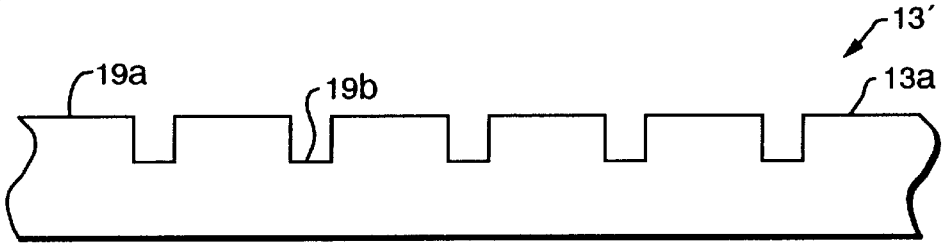
FIG. 2C is a side cross-sectional view of the substrate of FIG. 2A taken along the line 2C—2C in FIG. 2A.

FIG. 2A is a top plan view showing a preferred surface configuration for a substrate 13' of a second embodiment of the inventive end effector. FIG. 2B is a side cross-sectional view of the substrate 13' of FIG. 2A, taken along the line referenced by the letter "2B" in FIG. 2A; and FIG. 2C is a side cross sectional view of the substrate 13' taken along the line represented by letters "2C" in FIG. 2A. In the configuration shown in FIGS. 2A–2C the top surface 13*a'* of the substrate 13' has a plurality of regions of a first elevation 19*a* (mesas) and a plurality of regions of a second elevation 19*b* (valleys). Alternatively, the valleys 19*b* may comprise a plurality of cut-out regions or holes, rather than areas of low elevation. The mesas and valleys are preferably disposed across the entire surface of the substrate 13', in a diamond pattern best shown in FIG. 2A. As described below with reference to FIG. 3, when a matrix having diamond crystals embedded therein is disposed over the substrate 13', the mesa/valley configuration facilitates channeling of removed material and/or slurry. Moreover, experimental results show the mesa/valley configuration provides superior pad conditioning. The superior pad conditioning is believed to be attributable to the surface profile of the matrix's diamond tips which form a plurality of radially curved edges, as further described with reference to FIG. 3.

Figure 3:
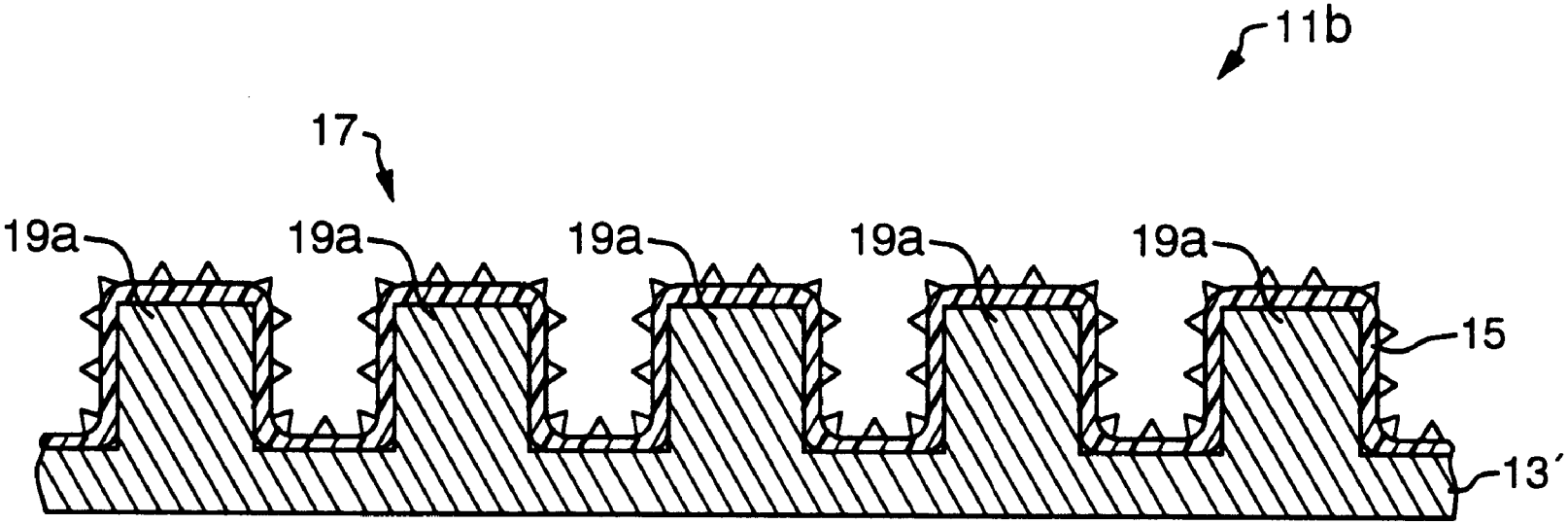
FIG. 3 is an enlarged side cross-sectional view of an embodiment of the inventive end effector which employs the substrate of FIGS. 2A–2C.

FIG. 3 shows an inventive end effector 11*b* which comprises the substrate 13' of FIGS. 2A–2C. The substrate 13' has the matrix 15 disposed thereon. Along the edges of the raised regions, or mesas 19*a*, the diamond tips extend in a radial manner, as shown. Thus, the end effector 11*b* has a surface profile of diamond tips comprising a plurality of radially curved edges while the diamond crystals 17 preferably maintain their orientation relative to the matrix 15. The angle at which the diamond crystals 17 (positioned along the edge of the mesas 19*a*) contact the polishing pad, is believed to contribute to the superior pad conditioning achieved with use of the end effector 11*b* of FIG. 3.

The end effector 11*b*, like the end effector 11*a* of FIG. 1, may be made in accordance with the methods disclosed in U.S. Pat. No. 5,380,390. As described therein, the matrix 15, which is a flexible material, can be formed on a first surface or carrier, and the crystals embedded therein and oriented, prior to moving the matrix to the substrate 13', to which the matrix 15 is to be adhered. In this manner, the crystals may be embedded and oriented while the matrix is positioned on a flat carrier surface. Thereafter, when the matrix 15 is transferred to the profiled substrate 13' and adhered thereto, the diamond tips will assume a radial orientation along the edges of the mesas 19*a*, as the flexible matrix 15 conforms to the surface profile of the substrate 13', while the diamond crystals 17 preferably maintain their orientation relative to the matrix 15.

The diamond crystals 17 of FIG. 3 preferably varying between 80–100 μm in length and have a 80–100 μm cross section 17'. Although synthetic diamond crystals may be easily grown to a desired size, in practice the crystals 17*a–c* may vary between 80–100 μm along any of the faces thereof. The diamond crystals 17 preferably are spaced approximately 200 μm between the centers of adjacent crystals. The matrix has a depth of 400 μm in order to enable the diamond crystals 17*a–c* to be embedded up to 60–80 μm within the matrix 15 and to withstand the forces applied during pad conditioning without causing the matrix 15 to crack or otherwise yield.

Figure 4:
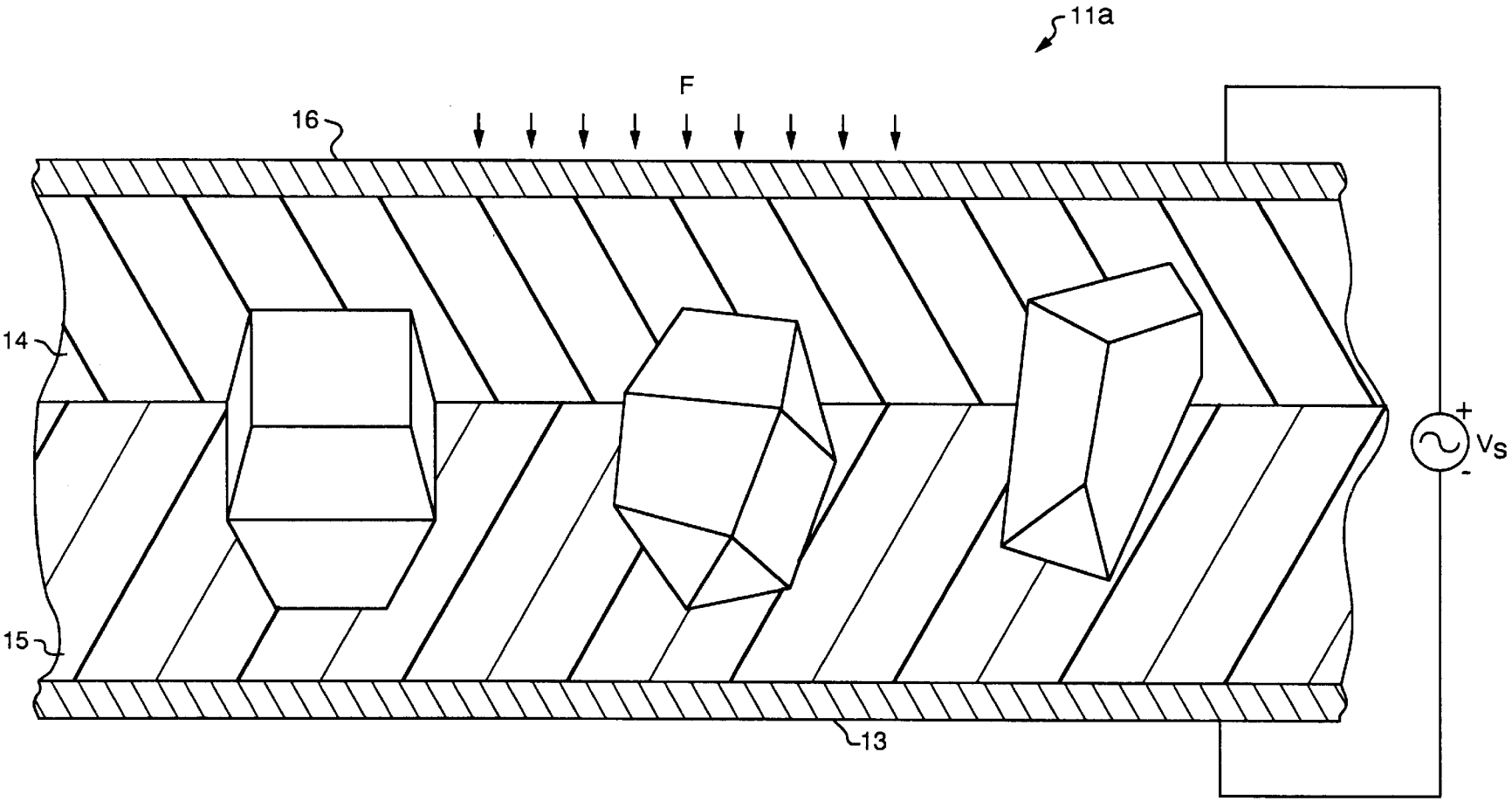
FIG. 4 is a side elevational view of the inventive end effector of FIG. 1A, showing an apparatus useful in monitoring the quality thereof.

FIG. 4 is a side elevational view of the inventive end effector 11*a* of FIG. 1 showing an apparatus useful in monitoring the quality thereof. Because the substrate 13 is preferably metal, the substrate 13 can act as a first capacitor plate. A sheet 14 of an insulating material such as a polyimid, is disposed in contact with the conditioning surface of the inventive end effector 11*a*, and a sheet 16 of conductive material (which acts as a second capacitor plate) is disposed in contact with the polyimid sheet. A downward force is applied to the second capacitor plate, and a voltage is applied between the first and second capacitor plates 13 and 16 respectively. The capacitance between the two plates 13, 16 is then measured. Any change in capacitance (from a predetermined value indicative of zero diamond crystal defects) indicates a change, e.g., a reduction, in the spacing between the first and second capacitor plates; and/or a change in the effective permitivity of the capacitor, i.e., the combined permitivity of the polyimid and the diamond crystals 17*a–c*. An increase in capacitance indicates the absence of, or the incorrect size of a diamond crystal, i.e., a diamond crystal defect. Accordingly the inventive end effector can be easily monitored to ensure consistent quality. Similarly, by measuring the capacitance before the end effector is used and after the end effector is used, a difference in capacitance indicates loss of crystals and the end of the end effector's useful life. The quality of the end effector 11*b* of FIG. 3 may be similarly monitored.

Figure 5:
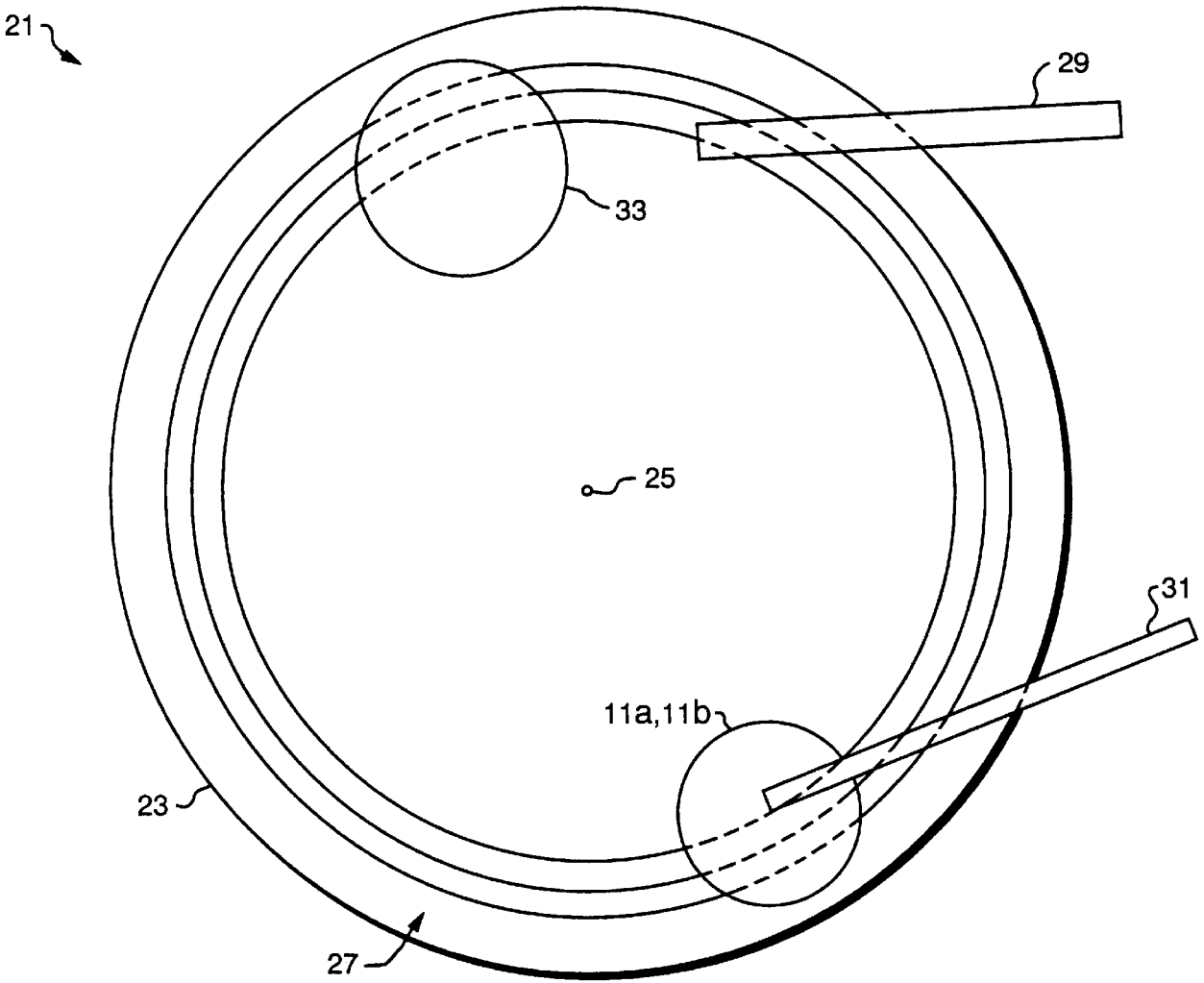
FIG. 5 is a top plan view of a polishing apparatus which employs the inventive end effector of FIGS. 1 or 3.

FIG. 5 shows a top plan view of a semiconductor device polishing apparatus 21 which employs the inventive end effector 11*a* or the inventive end effector 11*b*. The polishing apparatus 21 comprises a polishing pad 23 which rotates about a center point 25 at a given speed. The polishing pad 23 has a plurality of grooves 27 formed in the top surface of the polishing pad 23. These grooves aid the channeling of an abrasive slurry across the surface of the pad. The abrasive slurry (not shown) is supplied via an inlet 29. A conditioning arm 31 is rotatably disposed along the side of the polishing pad 23. The inventive end effector 11*a* or 11*b* is mounted to the conditioning arm 31.

In operation, the polishing pad 23 may be conditioned during the polishing of the semiconductor device (i.e., in situ conditioning) or during a separate pad conditioning step (i.e., ex situ conditioning). During in situ conditioning, a wafer 33 is mounted (as shown in FIG. 3) along one side of the conditioning pad and rotates in a first direction while being swept radially across the surface of the polishing pad 23. The polishing pad 23 rotates as the slurry (not shown) is supplied to the surface of the polishing pad via the inlet 29. Simultaneously therewith, the conditioning arm 31 sweeps the end effector 11*a* or 11*b*, which preferably rotates in the same direction the pad rotates, radially across the surface of the polishing pad 23 while applying a downward force. Preferably the end effector rotates at a rate of 20–120 r.p.m. and is pressed against the polishing pad 23 with a downward force of 7–10 pounds given the area of the end effector and density of diamonds. The inventive end effector 11*a* or 11*b*, with its optimally embedded, optimally spaced and sized diamond crystals having radially oriented or coplanar tips, provides a desired balance of polishing pad surface roughening, so that a consistent polish rate is maintained; and of polishing pad life, so that material and downtime costs are minimized.

The foregoing description discloses only the preferred embodiments of the invention, modifications of the above disclosed apparatus and method which fall within the scope of the invention will be readily apparent to those of ordinary skill in the art. For instance, although the polishing apparatus has been described as having a rotary arm for sweeping a rotating disc type end effector across the surface of the polishing pad, the inventive end effector may assume other shapes such as the stationary bar type conditioners disclosed in commonly assigned U.S. Pat. No. 6,036,583 (Ser. No. 08/890,781), filed Jul. 11, 1997 and titled "Apparatus for Conditioning a Polishing Pad in a Chemical Mechanical Polishing System," the entirety of which is incorporated herein by this reference, and may be employed with other types of polishing apparatuses such as those employing translating conditioning bands, etc. Accordingly, as used herein, a mechanism for moving the end effector across the polishing pad is to be construed broadly to cover movement of the end effector and/or movement (e.g., rotary, linear, etc.) of the polishing pad.

The invention applies to any end effector having a plurality of crystals embedded (i.e., held by material or chemical bonding, rather than by mechanical means) to a depth sufficient to maintain the crystals in place during repeated polishing cycles, and having radially oriented or coplanar crystal tips and/or predetermined crystal spacing such that the end effector may be repeatably manufactured and may enable repeatable pad conditioning. As used herein, when the plurality of crystals exhibit a property (e.g., spacing, depth of embedding, size, etc.) this refers to the approximate, on-average property exhibited by the crystals and each individual crystal need not exhibit the property. Similarly, where crystal tips are referred to as co-planer, it will be understood that the crystals on average extend from the matrix to approximately a common plane. Because the crystals are approximately the same size and are embedded approximately the same amount, the plane of the tips necessarily varies somewhat. Accordingly, while the present invention has been disclosed in connection with the preferred embodiments thereof, it should be understood that other embodiments may fall within the spirit and scope of the invention.

What is claimed is:

1. An end effector adapted to condition a polishing pad, comprising:

a substrate;

a matrix material adhered to a first surface of the substrate; and a plurality of crystals embedded in the matrix material an amount sufficient to prevent the plurality of crystals from becoming dislodged from the matrix material during pad conditioning; wherein each crystal is embedded by at least a predetermined percentage and wherein adjacent crystals are spaced from one another by a predetermined distance.

2. The apparatus of claim 1 wherein the matrix material is a polymer.

3. An apparatus for polishing a semiconductor wafer, comprising:

a polishing pad;

the end effector of claim 2 operatively coupled to the polishing pad; and a mechanism for moving the end effector across the surface of the polishing pad so that the plurality of crystals roughens the surface of the polishing pad.

4. The apparatus of claim 1 wherein the plurality of crystals have a common orientation.

5. The apparatus of claim 4 wherein each crystal is embedded in the matrix material by at least 75%.

6. An apparatus for polishing a semiconductor wafer, comprising:

a polishing pad;

the end effector of claim 5 operatively coupled to the polishing pad; and a mechanism for moving the end effector across the surface of the polishing pad so that the plurality of crystals roughens the surface of the polishing pad.

7. An apparatus for polishing a semiconductor wafer, comprising:

a polishing pad;

the end effector of claim 4 operatively coupled to the polishing pad; and a mechanism for moving the end effector across the surface of the polishing pad so that the plurality of crystals roughens the surface of the polishing pad.

8. The apparatus of claim 4 wherein the plurality of crystals comprises a known quantity of crystals.

9. An apparatus for polishing a semiconductor wafer, comprising:

a polishing pad;

the end effector of claim 8 operatively coupled to the polishing pad; and a mechanism for moving the end effector across the surface of the polishing pad so that the plurality of crystals roughens the surface of the polishing pad.

10. The apparatus of claim 4 wherein each crystal has a size in the range of 80–100 μm.

11. The apparatus of claim 10 wherein the plurality of crystals are spaced by approximately 200 μm center to center.

12. An apparatus for polishing a semiconductor wafer, comprising:

a polishing pad;

the end effector of claim 10 operatively coupled to the polishing pad; and a mechanism for moving the end effector across the surface of the polishing pad so that the plurality of crystals roughens the surface of the polishing pad.

13. The apparatus of claim 4 wherein each crystal has a size of approximately 200 μm.

14. The apparatus of claim 13 wherein the plurality of crystals are spaced by approximately 400 μm center to center.

15. An apparatus for polishing a semiconductor wafer, comprising:

a polishing pad;

the end effector of claim 13 operatively coupled to the polishing pad; and a mechanism for moving the end effector across the surface of the polishing pad so that the plurality of crystals roughens the surface of the polishing pad.

16. The apparatus of claim 4 wherein the plurality of crystals extend from the matrix material an approximately equal amount so as to form a approximately flat profile.

17. The apparatus of claim 16 wherein the plurality of crystals are spaced by approximately 400 μm center to center, and wherein each crystal has a size of approximately 200 μm.

18. The apparatus of claim 1 wherein the matrix material has a surface comprising a plurality of raised regions.

19. The apparatus of claim 18 wherein the plurality of crystals extend radially from at least a portion of the raised regions.

20. The apparatus of claim 18 wherein the matrix material has a surface comprising a plurality of valleys and a plurality of mesas.

21. The apparatus of claim 18 wherein each crystal is embedded in the matrix material by at least 75%.

22. The apparatus of claim 18 wherein the plurality of crystals comprises a predetermined quantity of crystals.

23. An apparatus for polishing a semiconductor wafer, comprising:

a polishing pad;

the end effector of claim 22 operatively coupled to the polishing pad; and a mechanism for moving the end effector across the surface of the polishing pad so that the plurality of crystals roughens the surface of the polishing pad.

24. The apparatus of claim 18 wherein each crystal has a size in the range of 80–100 μm.

25. The apparatus of claim 12 wherein the plurality of crystals are spaced by approximately 200 μm center to center.

26. The apparatus of claim 18 wherein each crystal has a size of approximately 200 μm.

27. An apparatus for polishing a semiconductor wafer, comprising:

a polishing pad;

the end effector of claim 26 operatively coupled to the polishing pad; and a mechanism for moving the end effector across the surface of the polishing pad so that the plurality of crystals roughens the surface of the polishing pad.

28. The apparatus of claim 18 wherein the plurality of crystals are spaced by approximately 400 μm center to center.

29. The apparatus of claim 18 wherein the plurality of crystals extend from the matrix material an approximately equal amount.

30. An apparatus for polishing a semiconductor wafer, comprising:

a polishing pad;

the end effector of claim 29 operatively coupled to the polishing pad; and a mechanism for moving the end effector across the surface of the polishing pad so that the plurality of crystals roughens the surface of the polishing pad.

31. The apparatus of claim 18 wherein the plurality of crystals are spaced by approximately 400 μm center to center, and wherein each crystal has a size of approximately 200 μm.

32. The apparatus of claim 18 wherein the plurality of crystals have a common orientation relative to the matrix material.

33. An apparatus for polishing a semiconductor wafer, comprising:

a polishing pad;

the end effector of claim 1 operatively coupled to the polishing pad; and a mechanism for moving the end effector across the surface of the polishing pad so that the plurality of crystals roughens the surface of the polishing pad.

34. The apparatus of claim 1 wherein each crystal is embedded in the matrix material by at least 75%.

35. The apparatus of claim 34 wherein the size of each crystal is at least 50% of the depth of the matrix material.

36. The apparatus of claim 34 wherein the matrix material has a surface comprising a plurality of raised regions.

37. The apparatus of claim 36 wherein the plurality of crystals extend radially from at least a portion of the raised regions.

38. The apparatus of claim 36 wherein the matrix material has a surface comprising a plurality of valleys and a plurality of mesas.

39. A method for checking the quality of an abrasive plate having a conductive substrate, and a matrix adhered to the substrate, the matrix having a plurality of abrasive particles embedded therein, comprising:

providing an abrasive plate having a conductive substrate and a matrix adhered to the substrate, the matrix having a plurality of abrasive particles embedded therein;

disposing an insulating material over the matrix;

disposing a conductive material over the insulating material;

applying a voltage between the conductive material and the substrate, while pressing the conductive material toward the conductive substrate;

measuring the capacitance between the conductive material and the substrate; and using the capacitance to determine whether any abrasive particle defects exist.

40. An end effector adapted to condition a polishing pad, comprising:

a substrate;

a matrix material adhered to a first surface of the substrate; and a plurality of crystals, each having an embedded end and a non-embedded end, the embedded end of each crystal being embedded in the matrix material by at least 75%.

41. The apparatus of claim 40 wherein the matrix material has a surface comprising a plurality of raised regions.

42. The apparatus of claim 41 wherein the plurality of crystals extend radially from at least a portion of the raised regions.

43. The apparatus of claim 41 wherein the matrix material has a surface comprising a plurality of valleys and a plurality of mesas.

44. The apparatus of claim 40 wherein the size of each crystal is at least 50% of the depth of the matrix material.

45. An apparatus adapted to polish a semiconductor wafer, comprising:

a polishing pad;

the end effector of claim 40 operatively coupled to the polishing pad; and a mechanism for moving the end effector across a surface of the polishing pad so that the plurality of crystals roughens the surface of the polishing pad.

46. An end effector adapted to condition a polishing pad, comprising:

a substrate;

a matrix material, adhered to a first surface of the substrate, having a surface comprising a plurality of raised regions; and a plurality of crystals embedded in the matrix material.

47. The apparatus of claim 46 wherein the plurality of crystals extend radially from at least a portion of the raised regions.

48. The apparatus of claim 46 wherein the matrix material has a surface comprising a plurality of valleys and a plurality of mesas.

49. An apparatus for polishing a semiconductor wafer, comprising:

a polishing pad;

the end effector of claim 40 operatively coupled to the polishing pad; and a mechanism adapted to move the end effector across a surface of the polishing pad so that the plurality of crystals roughens the surface of the polishing pad.

* * * * *